US006134977A

United States Patent [19]

Wessels

[11] Patent Number: 6,134,977

[45] Date of Patent: Oct. 24, 2000

[54] STARTER FOR INTERNAL COMBUSTION ENGINES

[75] Inventor: Siegbert Wessels, Hildesheim, Germany

[73] Assignee: Robert Bosch GmbH, Stuttgart, Germany

[21] Appl. No.: 09/180,624

[22] PCT Filed: Apr. 22, 1997

[86] PCT No.: PCT/DE97/00802

§ 371 Date: Nov. 12, 1998

§ 102(e) Date: Nov. 12, 1998

[87] PCT Pub. No.: WO97/49912

PCT Pub. Date: Dec. 31, 1997

[30] Foreign Application Priority Data

Jun. 22, 1996 [DE] Germany ..... 196 25 057

[51] Int. Cl.[7] ..... F02N 11/02

[52] U.S. Cl. ..... 74/7 A; 74/7 E

[58] Field of Search ..... 74/7 A, 7 E; 335/131

[56] References Cited

U.S. PATENT DOCUMENTS

| | | | |
|---|---|---|---|
| 4,346,615 | 8/1982 | Yoneda et al. | 74/7 A |
| 4,356,735 | 11/1982 | Bogner et al. | 74/7 A |
| 4,506,162 | 3/1985 | Bolenz et al. | 74/7 A |
| 4,561,316 | 12/1985 | Bolz et al. | 74/7 E |
| 4,579,010 | 4/1986 | Colvin et al. | 74/7 A |
| 5,167,162 | 12/1992 | Nagashima et al. | 74/7 A |
| 5,222,401 | 6/1993 | Fasola et al. | 74/7 A |
| 5,706,699 | 1/1998 | Moribayashi | 74/7 A |

FOREIGN PATENT DOCUMENTS

| | | | |
|---|---|---|---|
| 0 708 239 | 4/1996 | European Pat. Off. . | |
| 10914787 | 4/1955 | France | 74/7 A |
| 2 555 670 | 5/1985 | France . | |
| 25 48 358 | 5/1977 | Germany | 74/7 A |
| 32 17 655 A1 | 11/1983 | Germany . | |

*Primary Examiner*—David A. Bucci
*Assistant Examiner*—William C. Joyce
*Attorney, Agent, or Firm*—Michael J. Striker

[57] ABSTRACT

A cranking device (10) for internal combustion engines, in which the mounting of a gear arrangement (15) with a free-wheel coupling (25), a power takeoff shaft (17) and a shifting pinion (26) as well as a starting relay (30) on a intermediate plate (21) is to be automated. It is proposed that the intermediate plate (21) and a bearing block (36) for the deflection lever (27) of the starting relay (30) form an assembly unit, on which on the one hand the gear arrangement (15) with the power takeoff shaft (17) and the shifting pinion (26) as well as the starting relay (30) can be premounted, and in which on the other hand these parts can be joined together by the deflection lever (27) that is mounted in detent-lockable fashion on the bearing block (36).

14 Claims, 5 Drawing Sheets

FIG. 7
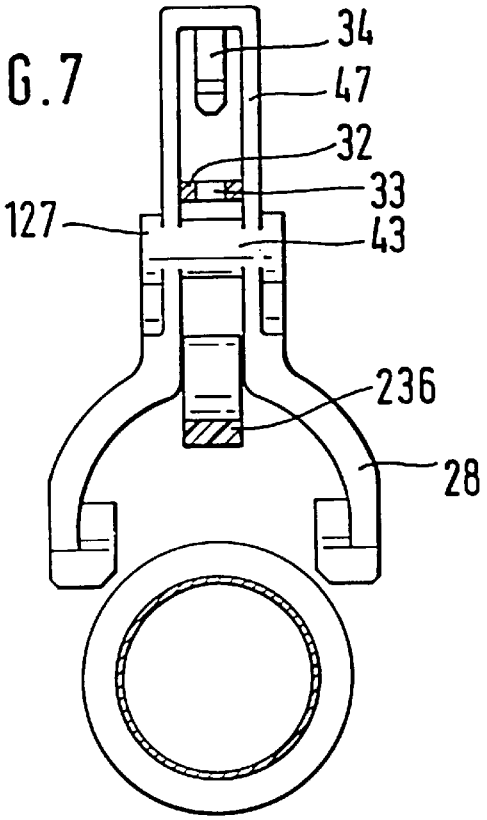
FIG. 6
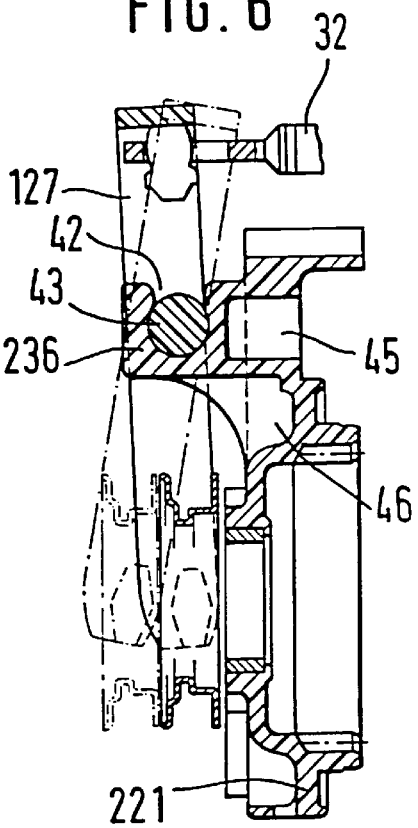
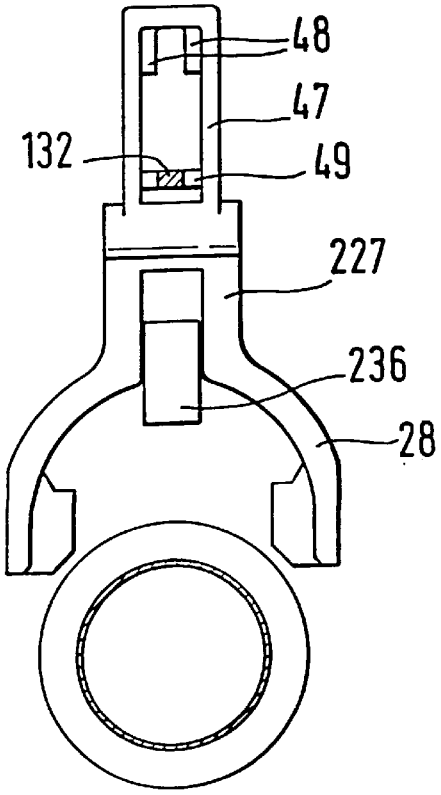
FIG. 8

STARTER FOR INTERNAL COMBUSTION ENGINES

BACKGROUND OF THE INVENTION

The invention is based on a cranking device for internal combustion engines.

From German Patent Disclosure DE-A 40 06 795, once such cranking device (starter) is known. In this version, an intermediate plate intended for a gear arrangement bearing, is widened toward the top in the form of a flange so that the starting relay will fit all the way into it; a bearing block for the deflection lever of the starting relay is inserted into the drive bearing plate. The bearing block is braced against the intermediate plate via a rubber plate.

Adapting the starter to geometric conditions in the installation space in the engine is done, with regard to the position of pinion repose and the extent of shifting for the pinion, especially by adapting the components in the group comprising the bearing block, the drive bearing plate, and the relay and tie rod (paddle). The modifications are limited to parts that are easy to make, in particular to the drive bearing plate, which is already a part that is specific for a particular vehicle manufacturer. When the cranking device is put together, however, joining together the drive bearing plate and the other parts of the cranking device does not meet the demands for a safely automatable assembly process, since in this operation the parts have to be put together simultaneously at a plurality of critical joining points; specifically, the drive bearing plate has to be put together in this way with the intermediate plate, the power takeoff shaft, the bearing block, and the rubber plate; and the intermediate plate has to be put together in this way with the relay fitting. Maintaining the relative position of these individual parts before enduring the assembly is especially problematic. A further difficulty is that in preassembly, the parts to be mounted on the intermediate plate can be shifted counter to one another by a shifting spring and a restoring spring, and the consequence is considerable effort in terms of readjustment work.

German Patent Disclosure DE-A 28 22 165 also discloses an embodiment in which the starting relay is inserted and firmly screwed into a fitting between the drive bearing plate and a sealing part of the starter housing. There, the shifting spring is disposed on a driving sleeve that carried both a free-wheel coupling and the shifting pinion. This embodiment without an intermediate plate still has the disadvantage of many joining points for the drive bearing plate, especially whenever a gear arrangement and an intermediate plate for the gear arrangement of the drive device is needed, especially since there again the spring forces of the shifting spring require readjustment of the pre-mounted parts.

Finally, from French Patent Disclosure FR-A 2 555 670, an embodiment is known in which an intermediate plate of the cranking device is joined to a plastic bearing block molded on by injection for a starting lever. When the gear arrangement and the starting relay are premounted on the intermediate plate, the forked lever must on the one hand be inserted on the gear arrangement and on the other must be secured both to the bearing block and to the tie rod of this starting relay by introducing bearing bolts. However, this cannot be done fully automatically, since the forked lever, loosely inserted on the gear arrangement in the preassembly process, is not positioned exactly enough, and thus the bearing pins have to inserted individually on the forked lever.

With the present embodiment, the goal is to improve the preassembly of the parts to be connected in the intermediate plate in such a way that fully automatic assembly of the cranking device becomes possible.

SUMMARY OF THE INVENTION

Accordingly, it is an object of the present invention to provide a cranking device for internal combustion engine which avoids the disadvantages of the prior art, the gear arrangement with the power takeoff shaft, the starting relay, the shifting pinion, optionally together with the free-wheel coupling and the deflection lever along with the shifting spring can be mounted in succession on the intermediate plate; because the deflection lever is supported on the bearing block that forms an assembly unit with the intermediate plate, the shifting spring now keeps these parts in position.

An especially advantageous provision for mounting the drive bearing plate is that this plate can be attached with merely two joining points, to the preassembled structural unit comprising the intermediate plate, gear arrangement, power takeoff shaft, shifting pinion, starting relay and deflection lever. A first joining point is formed by the plug-in unit of the end of the power takeoff shaft in the drive bearing plate. The second joining point is formed by a plug-in unit of the outer wall of the intermediate plate into a collar of the drive bearing plate. A rubber seal and a relay fitting are also located in the plug-in unit.

BRIEF DESCRIPTION OF DRAWINGS

FIG. 6 shows the intermediate plate with an integrated bearing block and the deflection lever mounted; and FIG. 7 shows the deflection lever from the front before insertion into the bearing block. FIG. 8 shows a deflection lever as an alternative to FIG. 7.

DESCRIPTION OF THE PREFERRED EMBODIMENTS

Figure 1:
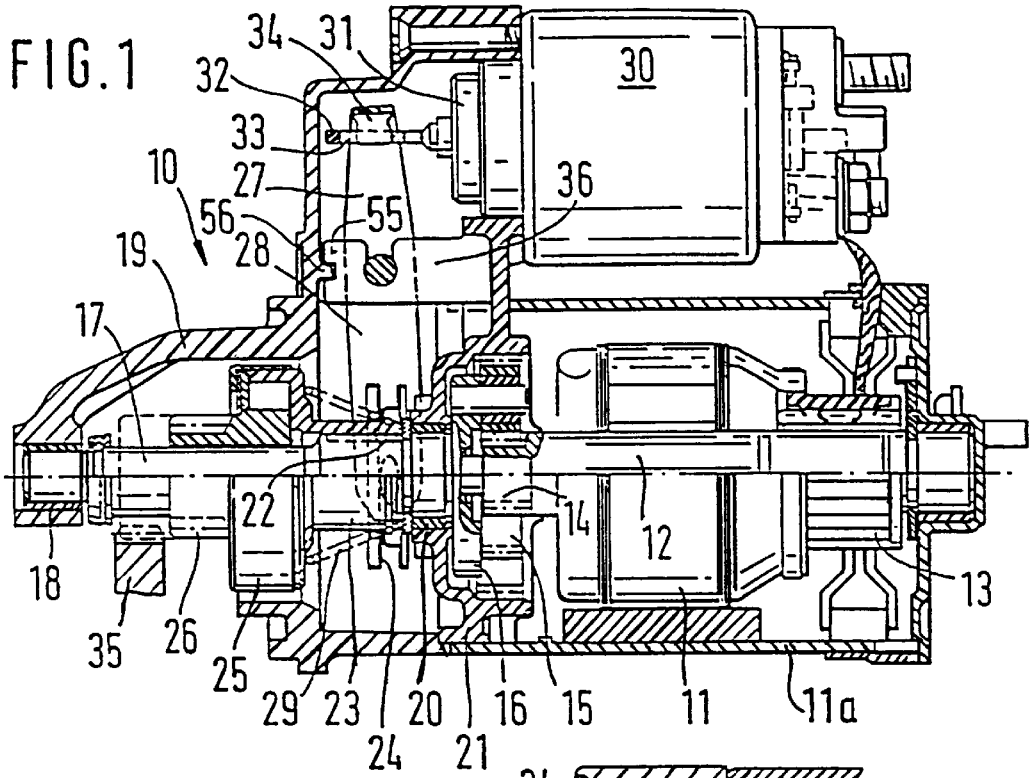
FIG. 1 shows a cross section through a cranking device in a first exemplary embodiment of the invention.

In FIG. 1, the cranking device for an internal combustion engine of a motor vehicle, shown in crossed section, is identified by reference numeral 10. It has a starting motor 11 driven by direct current, whose rotor shaft 12 has a commutator 13 on its rear end and a drive pinion 14 on its front end that as a sun wheel engages a planetary gear 15, known per se. The planetary gear is connected via a planet carrier 16 to a power takeoff shaft 17, whose outer end is received in a bearing 18 of a drive bearing plate 19. The planetary gear 15 is also received, via a further gear bearing 20, in an intermediate plate embodied as an intermediate plate 21, which is received and guided centrally both in the front terminal portion of the starting motor housing 11*a* and in the rear terminal portion of the drive bearing plate 19.

The rear portion of the power takeoff shaft 17, on its outer circumference, has an extra-coarse-pitch thread 22, on which a driving sleeve 23 is disposed so as to be both axially displaceable and rotatable by the extra-coarse-pitch thread. A U-shaped guide ring 24 is displaceably supported on the outside of the driving sleeve 23. A free-wheel coupling 25, whose inside wing in the front portion is embodied as a shifting pinion 26, is located as a further gear element on the front end of the driving sleeve 23. The guide ring 24 is engaged by a deflection lever 27, shown in further detail in FIG. 6, with a fork 28 embodied on its lower end. Inserted between the free-wheel coupling 25 and the guide ring 24 is a shifting spring 29, which on pre-tracking of the shifting pinion 26, in the case of a tooth-to-tooth position with a toothed ring 35 of an internal combustion engine, not shown, is braced by pivoting the deflection lever 27, and the pinion shifts into the toothed ring upon pinion rotation.

A starting relay 30 is inserted and screwed firmly above the starting motor between the intermediate plate 21 and the drive bearing plate 19. Secured to the armature 31 of the starting relay at the front is a tie rod 32, also known as a paddle, which has an elongated slot 33. This slot 33 is engaged by a journal 34 of the upper end of the deflection lever 27. A bearing block 36 is formed onto the intermediate plate 21, and the deflection lever 27 is pivotably supported on this bearing block. Activating the starting relay 30 starts the engine; on the one hand the deflection lever 27 is pivoted by the tie rod 32 of the starting relay 30 in such a way that the shifting pinion 26 shifts (shown in dashed lines) into the toothed ring 35 of the engine, and on the other hand, the starting motor 11 is turned on via a contact bridge of the starting relay. Via the planetary gear 15, the driving sleeve 23, the free-wheel coupling 25 and the shifting pinion 26, the toothed ring 35 is thus driven, for starting the engine. When the starting relay 20 is turned off, the armature 31 is rotated back into the outset position by a restoring spring 52 (FIG. 5), and in the process the deflection lever 27 is pivoted back again and the shifting pinion 26 is pulled out of the toothed ring 35. At the same time, the starting motor 11 is turned off.

Figure 2:
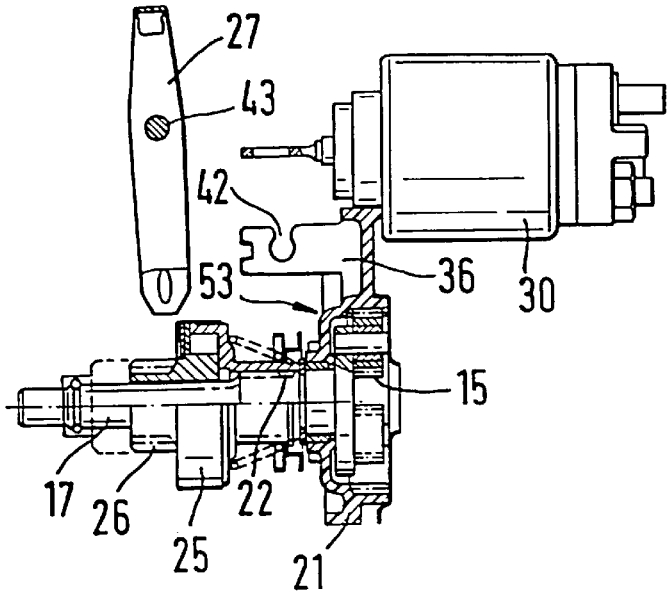
FIG. 2 shows an intermediate plate with a bearing block as an assembly unit with the preassembled parts comprising the gear arrangement, power takeoff shaft, pinion with coupling and shifting spring and the starting relay before the deflection lever is inserted.

To assure improved, automatable assembly of the cranking device, the intermediate plate 21 and the bearing block 36 form an assembly unit 53, on which the gear arrangement 15 with the power takeoff shaft 17 and the shifting pinion 26, axially displaceable on it via an extra-coarse-pitch thread 22, on the one hand and the starting relay 30 on the other are pre-mounted. FIG. 2 shows one such pre-mounted arrangement, with the free-wheel coupling 25 associated with the shifting pinion 26; as an alternative, however, the free-wheel coupling may also be associated as a stationary free-wheel coupling with the gear arrangement. The deflection lever 27 is still initially provided there.

Figure 3:
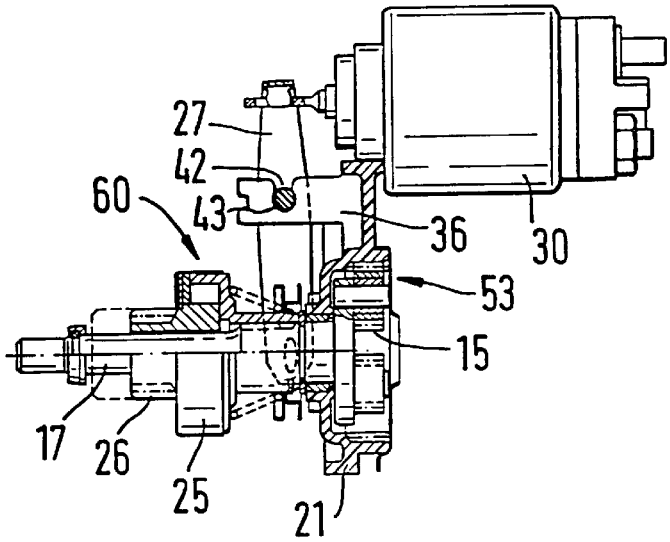
FIG. 3 shows the preassembled structural unit of FIG. 2 with the deflection lever inserted.

FIG. 3 shows the deflection lever 27, mounted on the bearing block 36 in detent-lockable fashion, which connects the starting relay 30 with the shifting pinion 26 and the associated free-wheel coupling 25 on the power takeoff shaft 17. The intermediate plate 21 with the bearing block 36, gear arrangement 15, power takeoff shaft 17, shifting pinion 26 with the free-wheel coupling 25, and starting relay 30 with the deflection lever 27 all form a preassembled structural unit of parts joined to one another, whose position relative to one another is stabilized upon the insertion of the deflection lever 27.

Figure 4:
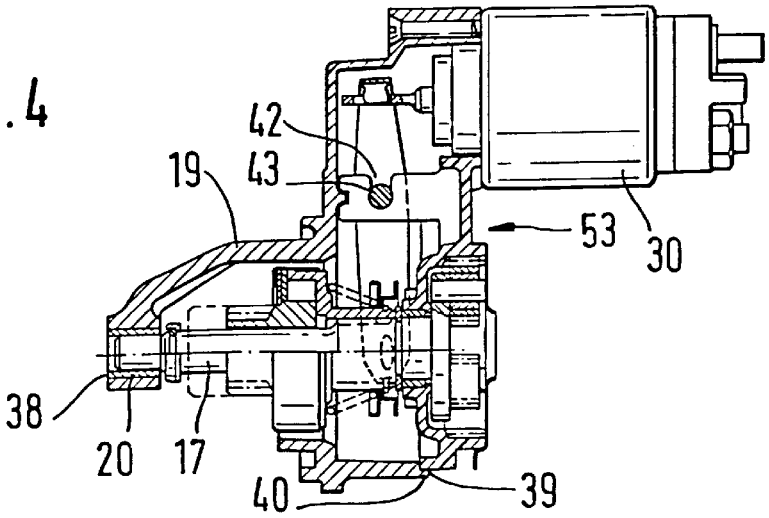
FIG. 4 shows the preassembled structural unit with the drive bearing plate attached.

In FIG. 4, onto the thus-preassembled structural unit, the drive bearing plate 19 is mounted at only two joining points 38 and 39. The first joining point 38 forms the bearing 20 into the drive bearing plate 19, into which the end of the power takeoff shaft 17 is introduced. The second joining point 39 is formed by a collar 40 on the outer circumference of the drive bearing plate 39, into which the outer wall of the intermediate plate 21 is introduced.

In the first exemplary embodiment shown in FIGS. 1–4, the bearing block is embodied integrally with the intermediate plate 21 as an injection molded plastic part. The bearing block 36 has a somewhat constricted bearing bore 42, which is open at the top and into which a bearing journal 43 of the deflection lever 27 can be inserted in detent-lockable fashion.

Figure 5:
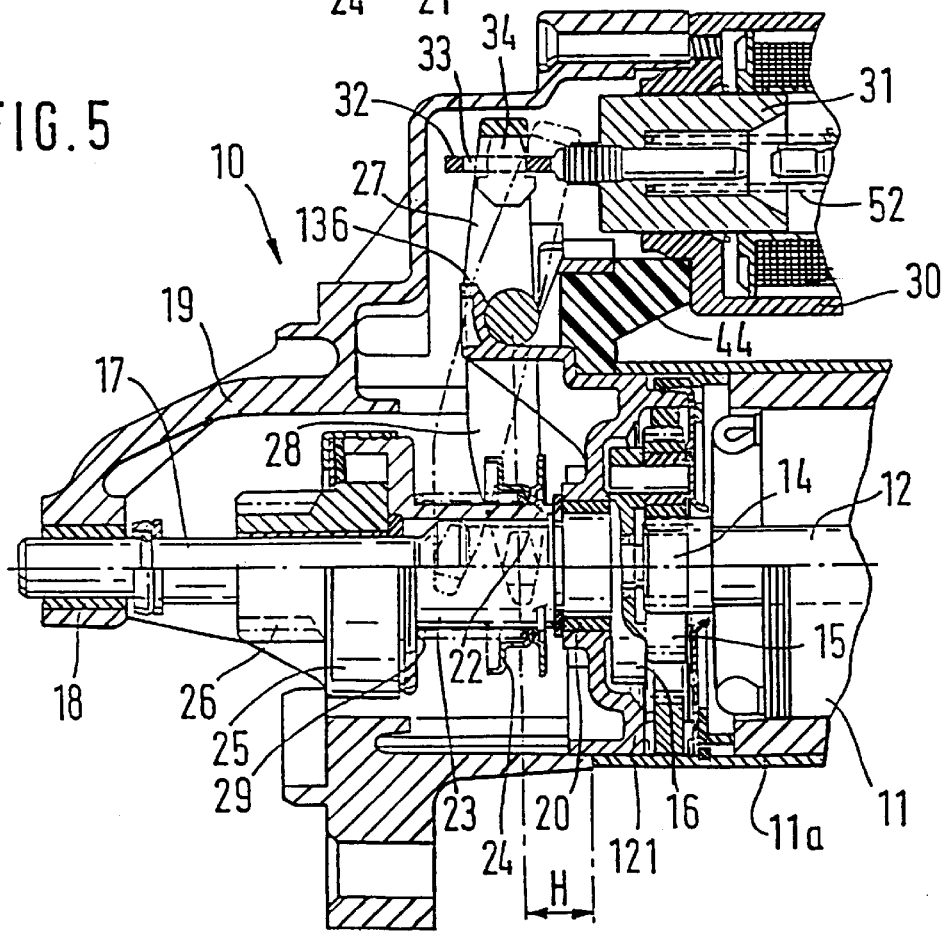
FIG. 5 shows a cross section through the front part of a cranking device in a second exemplary embodiment.

In FIG. 5, a further exemplary embodiment of the invention is shown; here only the front part of the cranking device is shown in cross section. In this embodiment, an intermediate plate 121 made of fiber-reinforced plastic or some suitably dimensionally resistant material is shown, which is injected or cast in a suitable mold. For better adaptation of the dimension H (FIG. 5) to the customer-required installation situation, a rear opening is provided on the intermediate plate 121 in the region of the bearing block 136, in which opening a sealing element 44 of plastic or hard rubber is inserted. The construction shown makes possible a modular tool design which can be equipped, in a way free of crosswise shifting, for different dimensions H by changing only a few parts.

FIG. 6, as a further exemplary embodiment of the intermediate plate 221, shows an injection-molded or cast embodiment in which instead of the opening in the region of the bearing block 236, a mold depression 45 is provided. A support rib 46 is formed below the bearing block. In this embodiment as well, a deflection lever 127 is locked in detent fashion with its bearing journal 43 into the bearing bore 42 that is open at the top; the shifting position is shown in dashed lines. In FIG. 7, the deflection lever 127 is shown in a front view, specifically before insertion into the bearing block 236. It can be seen here that the upward-oriented leg of the deflection lever 127 is embodied as a bail 47. The free end of the tie rod 32 of the starting relay protrudes through this bail 47. Onto the top of the bail 47, a downward-pointing journal 34 is molded on; it engages the elongated slot 33 on the flat end of the tie rod 32.

FIG. 8 shows a different embodiment of the deflection lever 227 in the region of the bail 47. Two opposed tabs 48 facing one another are formed onto the upper region of the bail 47 and engage corresponding opposed lateral recesses 49 on the flat end of the tie rod 132.

It can be seen from FIG. 6 in conjunction with FIG. 7 that the bearing block 236 forms a forward-protruding bracket, onto which the tines of a fork 28 of the deflection lever 27 are thrust, and in which the bearing journal 43 of the deflection lever 127 can be inserted in lockable fashion into the bearing bore 42 that is open at the top.

Figure 9:
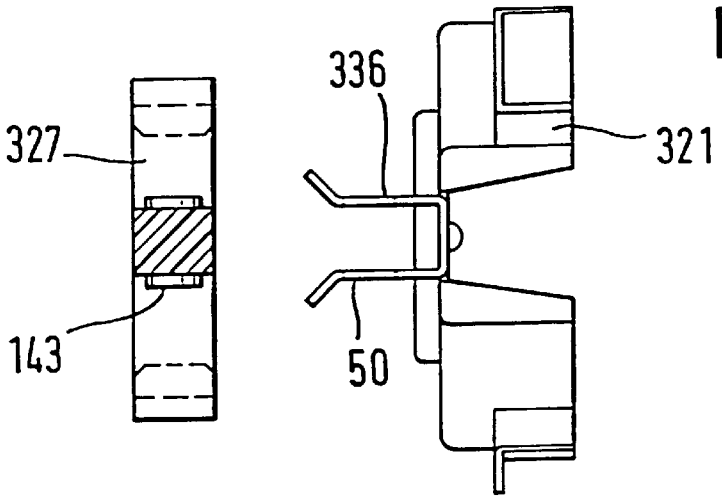
FIGS. 9 and 10 show an intermediate plate as an alternative to that of FIG. 6, made of sheet metal with a deflection lever that fits it.
Figure 10:
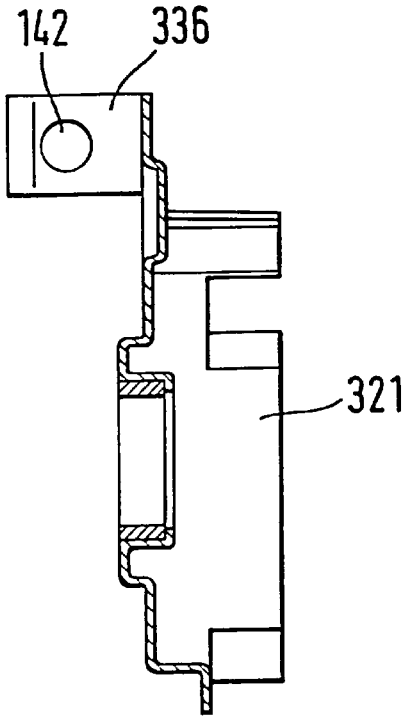

FIGS. 9 and 10 show a further exemplary embodiment of an intermediate plate 321, which is stamped and shaped from a metal sheet jointly with the bearing block 336. In this embodiment, the bearing block 336 forms a U-shaped console open at the front, with lateral bearing bores 142 in the legs of the bracket. A deflection lever 327 shown in plan view in FIG. 9 here has bearing journals 143 formed onto both sides in its bearing region. When the bearing region of the deflection lever 327 is thrust into the bearing block 336, the legs 50 of the bracket are forced elastically apart far enough that the bearing journals 143 snap in detent fashion into the bearing bores 142. The sheet-metal part can be designed such that the same joining direction for the forked lever as for the plastic intermediate bearing is achieved here.

Figure 11:
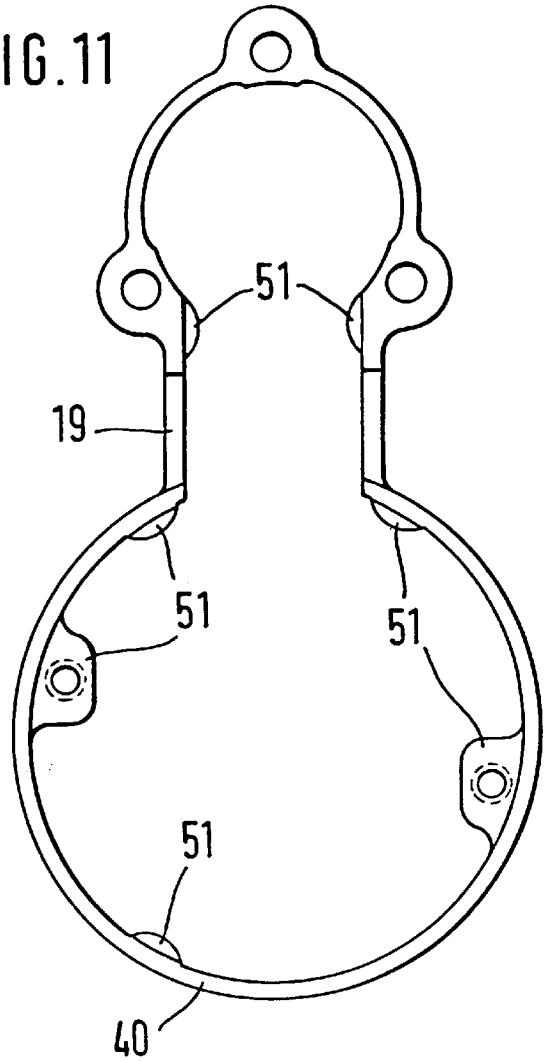
FIG. 11 shows the drive bearing plate of the cranking device of FIG. 1 with supports for the intermediate plate.

FIG. 11 shows the drive bearing plate 19 in its outlines in a rear view. For resting unequivocally on the intermediate plate 21, five stop shoulders 51 distributed over the circumference of the collar 40 are provided here. For the upper portion of the intermediate plate 21, which has the bearing block 36, two further stop shoulders 51 are provided. A sealing element 44 is introduced from behind in the region of the bearing block 336, before the starting relay 30 and the starting motor 11 are mounted.

Since the intermediate plate can be firmly fastened to a work piece carrier during assembly, all the parts to be mounted on it can be joined nondisplaceably to one another by the deflection lever; the shifting spring 29 and the armature restoring spring 52 of the starting relay 30 can take on a holding function as a result of the insertion of the deflection lever into the bearing block. The starting motor 11 in this version can be preassembled as before. It is then mounted onto the intermediate plate 21 from the backside and finally, like the starting relay 30, it is screwed to the drive bearing plate 19.

Figure 12:
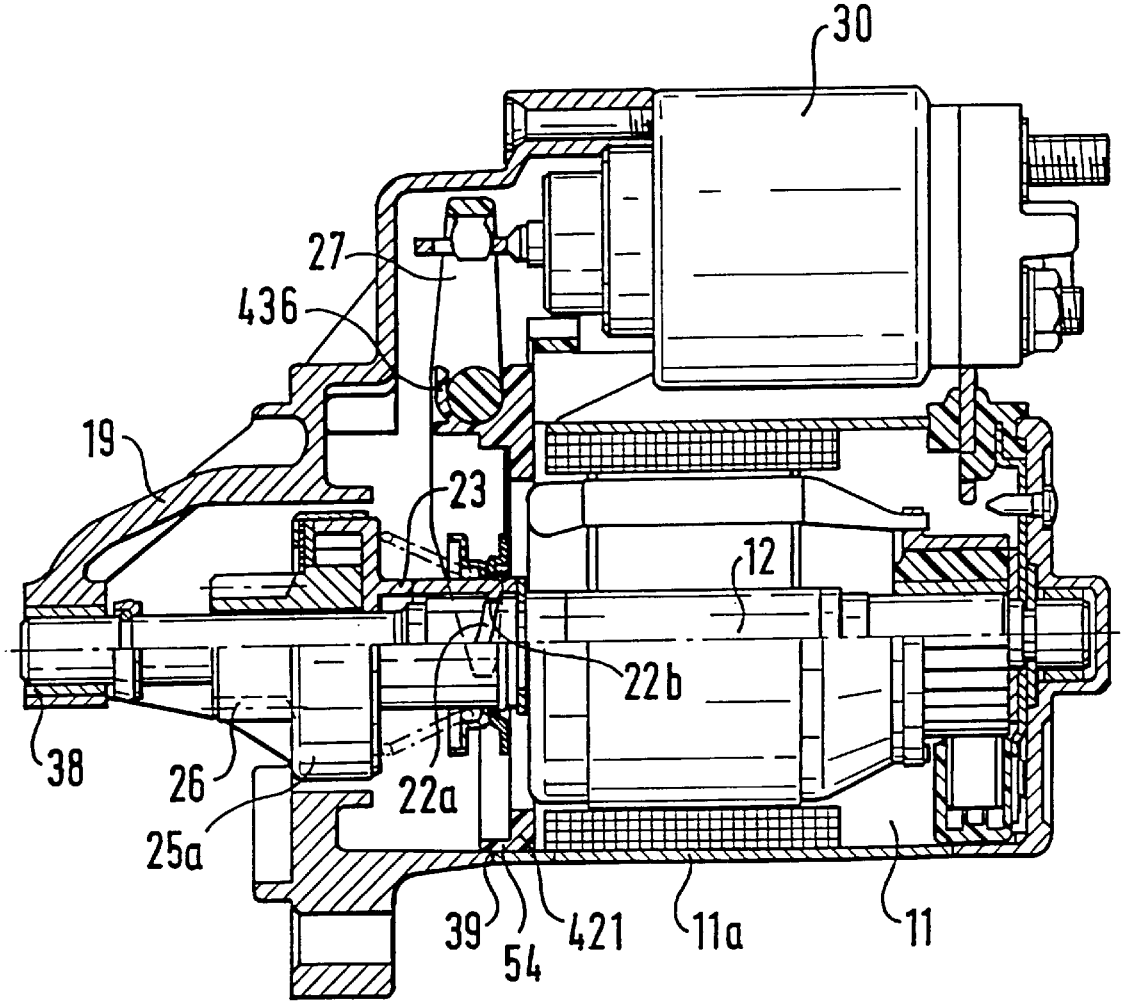
FIG. 12 shows a cranking device without an intermediate gear, as a further exemplary embodiment.

In FIG. 12, as a further exemplary embodiment, a cranking device is shown which without a planetary gear-intermediate gear drives the engine via its toothed ring, not shown, directly by the shifting pinion 26. The starting motor 11 is coupled here with its rotor shaft 12 directly to the shifting pinion 26 via the free-wheel coupling 25*a*. As in the previous exemplary embodiments, here as well the free-wheel coupling 25*a* is axially displaceable jointly with the shifting pinion 26 by the starting relay 30 via the deflection lever 27. The pinion rotation upon pretracking of the shifting pinion 26 is effected via an extra-coarse-pitch thread 22*a*, which is attached to the front portion of the rotor shaft 12. This extra-coarse-pitch thread 22*a* is engaged by internal protrusions 22*b*, which are disposed on the inside of the driving sleeve 23 and upon pretracking of the shifting pinion 26 cause a relative rotation between the free-wheel coupling 25*a* with the pinion 26, on the one hand, and the rotor 12, on the other.

The bearing block 436 for the deflection lever 27 is formed here onto an intermediate plate 421, which in its upper portion as in the first exemplary embodiment is embodied to receive the starting relay 30. In the lower portion, a collar ring 54 is formed on, with which a centered reception of the intermediate plate 421 on both the front terminal portion of the housing 11*a* of the starting motor 11 and the rear terminal portion of the drive bearing plate 19 is achieved. An intermediate bearing point, of the kind contemplated in the first exemplary embodiment in the cranking device with the intermediate gear by the gear arrangement bearing 20, is not needed in this embodiment having the direct-drive starter.

When this cranking device is put together, accordingly first a preassembly of the starting relay 30, free-wheel coupling 25*a* and deflection lever 27 on the intermediate plate 421 is accomplished. After that, the drive bearing plate 19 is placed onto this preassembled assembly unit at the joining points 38 and 39—as described for the first exemplary embodiment. Next, from the other side, the starting motor 11 is seated on the collar ring 54 of the intermediate plate 421, and finally the starting relay 30 and starting motor 11 are firmly screwed to the drive bearing plate 19.

Thus the intermediate plate or intermediate plate, which in its construction is combined with the bearing block of the deflection lever, is essential to the invention. This creates a complete gear module, in which all the individual gears, such as free-running, planetary and shifting gears are combined. The bearing block and the intermediate plate may also be embodied in two parts, but these two parts are put together in a fixed connection in the joined state, such as a dovetail connection, to make an assembly unit. If a sealing element 44 as in the embodiment of FIG. 5 is used, then it is possible for the starting relay to be received on the drive bearing plate 19 and the sealing element 44, regardless of the embodiment of the intermediate plate, with the advantage that further adaptations to given installation conditions of the cranking device are thereby possible in a simple way.

Since when the intermediate plate is made of plastic the bearing block can run the risk of breakage from frequent abrupt stress, it is further proposed to secure against breakage, in accordance with the first exemplary embodiment, that the bearing block 36 be reinforced with a bracket 55, which is oriented toward the drive bearing plate 19 and is engaged by a shoulder 56 formed onto the drive bearing plate 19, so that the bearing block 36 is braced with its bracket 55 on this shoulder 56.

What is claimed is:

1. An engine arrangement for internal combustion engines, having a starting motor, a gear arrangement (15), a free-wheel coupling, a power takeoff shift (17), and a shifting pinion (26), which can be shifted axially displaceably by a guide ring (24) into a toothed ring of the engine by a starting relay (30) via deflection lever (27, 127, 227, 327) pivotably supported on a bearing block (36, 136, 236, 336, 436), and an intermediate plate (21, 121, 221, 321, 421) receives a gear member and the starting relay and is inserted between a housing of the starting motor on the one hand and a drive bearing plate on the other, and wherein the intermediate plate and the bearing block form an assembly unit (53), on which the gear arrangement with the power takeoff shaft and the shifting pinion, on the one hand, and the starting relay on the other can be pre-mounted, and are to be joined together via the deflection lever (27, 127, 227, 327), the deflection lever (27, 127, 227, 327) in the pre-assembled state is locked in detent fashion on the bearing block (36, 136, 236, 336, 436) and is inserted from above into the guide ring (24) and simultaneously into the bearing block (36, 136, 236, 336, 436) so as to be locked in detent fashion by the bearing block (36, 136, 236, 336, 436).

2. An engine arrangement as defined in claim 1, wherein the drive bearing plate (19) can be set onto a pre-mounted structural unit, formed on the intermediate plate (21) with the bearing block (36), the gear arrangement (15), the power takeoff shaft (17), the shifting pinion (26), the starting relay (30), and the deflection lever (27), at two joining points (38, 39), the one joining point (38) being formed by inserting the end of the power takeoff shaft into the bearing (18) of the drive bearing plate (19) and the other joining point (38) being formed by inserting an outer wall (41) of the intermediate plate (21) into a collar (40) of the drive bearing plate (19).

3. An engine arrangement as defined in claim 1 wherein the bearing block (36) is formed integrally with the intermediate plate (21) and has a bearing bore (42), open at the top, for snapping a bearing journal (43) of the deflection lever (27) into it.

4. An engine arrangement as defined in claim 3, wherein the bearing block (36) forms a bracket; onto which the tines of a fork (28) of the deflection lever (27) are thrust, and a bearing journal (43) of the deflection lever (27) can be introduces in detent fashion into the bearing bore (42) that is open at the top.

5. An engine arrangement as defined in claim 1, wherein the bearing block (336) forms a U-shaped bracket, open at a front, into which the deflection lever (327) is thrust and can be introduced in detent fashion, with bearing journals (143) on both sides, into bearing bores (142) in the legs (50) of the bracket.

6. An engine arrangement as defined in claim 3, wherein the intermediate plate (321) together with the bearing block (236) is stamped out of a sheet-metal part and shaped.

7. An engine arrangement as defined in claim 3, wherein the intermediate plate (121) together with the bearing block (136) is injection-molded or cast from a dimensionally stable material.

8. An engine arrangement as defined in claim 1, wherein a sealing element (44) is inserted onto the bearing block (136) from a back side of the intermediate plate (121).

9. An engine arrangement as defined in claim 1, wherein an upper leg of the deflection lever (127) forms a bail (47), in which the end of a tie rod (32) of the starting relay (30) is received.

10. An engine arrangement defined in claim 9, wherein a downward-pointing journal (34) formed onto a top of the bail (47) engages an elongated slot (33) on a flat end of the tie rod (32).

11. An engine arrangement as defined in claim 1, wherein that the bearing block (36) is braced with a bracket (55) against a shoulder (56) of the drive bearing plate (19).

12. An engine arrangement as defined in claim 1, wherein the intermediate plate (221) is centrally received and guided by an integral collar ring (54), without an intermediate bearing point, both in a front end region of the housing (11*a*) of the start motor (11) and in a rear end region of the drive bearing plate (19).

13. A cranking device for internal combustion engines, having a starting motor, a gear arrangement (15), a free-wheel coupling, a power takeoff shaft (17), and a shifting pinion (26), which can be shifted axially displaceably into a toothed ring of the engine by a starting relay (30) via a detection lever (27, 127, 227, 327) pivotably supported on a bearing block (36, 136, 236, 336, 436), and an intermediate plate (21, 121, 221, 321, 421) receives a gear member and the starting relay and is inserted between a housing of the starting motor on the one hand and a drive bearing plate on the other, and wherein the intermediate plate and the bearing block form an assembly unit (53), on which the gear arrangement with the power takeoff shaft and the shifting pinion, on the one hand, and the starting relay on the other can be pre-mounted, and are to be joined together via the deflection lever (27, 127, 227, 327), the deflection lever (27, 127, 227, 327) in the pre-assembled state is locked in detent fashion on the bearing block (36, 136, 236, 336, 436), the deflection lever (127), with its upper leg, forms a bail (47), in which the end of a tie rod (32) of the starting relay (30) is received, two tabs (48) facing one another are formed onto the sides of the bail (47) and engage corresponding opposed lateral recesses (49) on a flat end of the tie rod (32).

14. A cranking device for internal combustion engines, having a starting motor, a gear arrangement (15), a free-wheel coupling, a power takeoff shaft (17), and a shifting pinion (26), which can be shifted axially disolaceably into a toothed ring of the engine by a starting relay (30) via a deflection lever (27, 127, 227, 327) pivotably supported on a bearing block (36, 136, 236, 336, 436), and an intermediate plate (21, 121, 221, 321, 421) receives a gear member and the starting relay and is inserted between a housing of the starting motor on the one hand and a drive bearing plate on the other, and wherein the intermediate plate and the bearing block form an assembly unit (53), on which the gear arrangement with the power takeoff shaft and the shifting pinion, on the one hand, and the starting relay on the other can be pre-mounted, and are to be joined together via the deflection lever (27, 127, 227, 327), the deflection lever (27, 127, 227, 327) in the pre-assembled state is locked in detent fashion on the bearing block (36, 136, 236, 336, 436), the bearing plate (19) can be set onto a pre-mounted structural unit, formed of the intermediate plate (21) with the bearing block (36), the gear arrangement (15), the power takeoff shaft (17), the shifting pinion (26), the starting relay (30), and the deflection lever (27), at two joining points (38, 39), the one joining point (38) being formed by inserting the end of the power takeoff shaft into a bearing (18) of the drive bearing plate (19) and the other joining point (38) being formed by inserting an outer wall (41) if the intermediate plate (21) into a collar (40) of the drive bearing plate (19), the drive bearing plate (19), in the region of the collar (40), has a plurality of stop shoulders (51) for the intermediate plate (21).

* * * * *